US007111795B2

(12) United States Patent
Thong

(10) Patent No.: US 7,111,795 B2
(45) Date of Patent: Sep. 26, 2006

(54) REVOLVING SPRAY SHOWER HEAD

(75) Inventor: Chow Hwa Thong, Fujian (CN)

(73) Assignee: Waxman Consumer Products Group, Inc., Bedford Heights, OH (US)

( * ) Notice: Subject to any disclaimer, the term of this patent is extended or adjusted under 35 U.S.C. 154(b) by 84 days.

(21) Appl. No.: 10/845,917

(22) Filed: May 14, 2004

(65) Prior Publication Data

US 2005/0263617 A1 Dec. 1, 2005

(51) Int. Cl.
*B05B 1/34* (2006.01)

(52) U.S. Cl. ..... 239/383; 239/222.15; 239/237; 239/251; 239/381; 239/443; 239/446; 239/449; 239/525; 239/530

(58) Field of Classification Search ..... 239/214, 239/222.11, 222.13, 222.15, 237, 240, 251, 239/380–383, 436, 443, 444, 446–449, 525, 239/530, 533.13, 533.14, 602, DIG. 12
See application file for complete search history.

(56) References Cited

U.S. PATENT DOCUMENTS

| | | | | |
|---|---|---|---|---|
| 4,754,928 | A | 7/1988 | Rogers et al. | |
| 4,923,120 | A | 5/1990 | Hammelmann | |
| 5,090,624 | A | 2/1992 | Rogers | |
| 5,207,499 | A | 5/1993 | Vajda et al. | |
| 5,242,113 | A * | 9/1993 | Manderson | 239/251 |
| 5,248,092 | A | 9/1993 | Rankin | |
| 5,294,054 | A | 3/1994 | Benedict et al. | |
| 5,316,216 | A * | 5/1994 | Cammack et al. | 239/449 |
| 5,356,077 | A | 10/1994 | Shames et al. | |
| 5,467,927 | A * | 11/1995 | Lee | 239/383 |
| 5,632,446 | A | 5/1997 | Krochek | |
| 5,704,547 | A | 1/1998 | Golan et al. | |
| 6,076,743 | A | 6/2000 | Fan | |
| 6,092,739 | A | 7/2000 | Clearman et al. | |
| 6,186,414 | B1 | 2/2001 | Clearman et al. | |
| 6,199,771 | B1 | 3/2001 | Clearman et al. | |
| 6,254,014 | B1 | 7/2001 | Clearman et al. | |
| 6,276,614 | B1 | 8/2001 | Huang | |
| D454,617 | S | 3/2002 | Curbbun et al. | |
| 6,412,710 | B1 | 7/2002 | Lin et al. | |
| D464,708 | S | 10/2002 | Dempsey et al. | |
| D465,262 | S | 11/2002 | Hunter et al. | |
| 6,527,204 | B1 | 3/2003 | Heitzman | |
| 6,607,148 | B1 | 8/2003 | Marsh et al. | |
| 6,648,245 | B1 | 11/2003 | Samwell et al. | |
| 6,676,037 | B1 | 1/2004 | Marks | |
| 6,719,218 | B1 * | 4/2004 | Cool et al. | 239/443 |
| 6,736,336 | B1 * | 5/2004 | Wong | 239/446 |

* cited by examiner

*Primary Examiner*—Steven J. Ganey
(74) *Attorney, Agent, or Firm*—Watts Hoffmann Co, LPA

(57) ABSTRACT

A shower head with structural features for providing a water spray pattern having revolving characteristics is disclosed. The shower head includes an inlet assembly connectable to a water source and a cooperatively engaged outlet assembly including a body having a front facing surface, an impeller having a plurality of blades and a rotator assembly having a spray surface defining a plurality of spray apertures. The rotator spray surface forms a portion of the front facing surface. A seal spacer disposed between the inlet assembly and the front facing surface has a plurality of radially spaced ports. Each port is axially transverse to a plane of the seal spacer. Water flow through the ports creates a multi-directional water current downstream from the spacer to drive the impeller and consequently, cause rotation of the rotator spray surface and water emission in a revolving spray pattern.

47 Claims, 7 Drawing Sheets

REVOLVING SPRAY SHOWER HEAD

FIELD OF THE INVENTION

The present invention relates to a shower head and more particularly to a shower head having structural features for providing a water spray pattern having aesthetic revolving characteristics.

BACKGROUND OF THE INVENTION

A wide variety of shower heads are known in the art for installation in conjunction with residential plumbing. They can be used to provide various flow rates and pressures, and pulsating and non-pulsating flow. These types of shower heads are increasingly popular and provide a variety of massaging flow patterns. Different flow patterns appeal to individual consumer taste.

Certain devices used to produce pulsating flow include internal impellers or rotators that rotate when in communication with water flowing through the shower head. Other designs produce an oscillating pattern by use of a wobbling member mounted internally within a nozzle housing. Still other designs rely on the cam action of a rotator actuating member to produce pulsating water emission. Consumers of such devices demand additional variety in the art, both in the style and the flow pattern produced. Further, a need exists for increased simplicity and lower cost of these devices.

The present invention provides a new and improved shower head for providing a water spray pattern having aesthetic revolving characteristics. Handheld and fixed embodiments of the present invention use a rotator to directly emit water through a series of apertures therein to produce a rotating spray pattern. The present invention uses a two part design wherein a fixed inlet assembly is rotatably engaged to an outlet assembly. A plurality of spray patterns are selectable by the user. The spray surface of a rotator spins in relation to a fixed portion of the shower head spray surface. This spinning surface creates a revolving spray pattern as water is emitted through apertures in the surface. The fixed portions of the showerhead spray surface produce a bubbling spray and a non-revolving full spray as selected by the user. Further, the present invention is unique in construction and easy to install.

SUMMARY OF THE INVENTION

In illustrated embodiments of the invention, a fixed shower head and a handheld shower head, each providing a revolving water spray pattern having aesthetically and physically advantageous characteristics, are disclosed. It should be understood that the illustrations of the specific fixed shower head and a handheld shower head shapes and styles are for exemplary purposes only, and the present invention may be practiced with any type of water dispensing device.

In one embodiment, a fixed shower head for emitting a revolving spray pattern includes an inlet assembly having an inlet end for mounting to a water source connection and an outlet assembly in cooperative engagement therewith. The inlet assembly is disposed downstream from the inlet assembly and permits water flow from the water source through the outlet assembly. Water may flow through one or more of at least three passageways as diverted by user manipulation of a dial ring.

The outlet assembly includes a body defining a front face surface, a rotatable impeller disposed in a spaced relationship between the inlet assembly and the front face surface and having a plurality of blades and an elongated tubular hub protruding downstream, and a rotator assembly mounted to the tubular hub and including a spray surface defining a plurality of spray apertures. Water entering the tubular hub exits the outlet assembly through the spray apertures. The rotator spray surface forms a portion of the outer assembly front face surface. Water flow through the outer assembly drives the impeller thereby causing rotation of the rotator spray surface and water emission in a revolving spray pattern.

The outlet assembly may include a bubbling spray generator apparatus including an inlet portion, at least one wire mesh annular filter, a bubble gasket and an outlet portion. The apparatus generates a bubbling spray when water flow traverses the inlet and outlet portions.

The inlet assembly may further include a fixed seat. The outlet assembly may further include a spray generator apparatus including a spray ring and a plurality of flexible nozzles. The apparatus generates a spray when an operator manipulates the spray ring in relation to the fixed seat to divert water flow to the flexible nozzles. The outlet assembly may include means for generating a non-revolving spray pattern.

The outlet assembly may include a dial ring, wherein an operator may adjust the dial ring thereby manipulating the spray ring with respect to the fixed seat to divert water to one of at least three flow paths. The outlet assembly may include means for diverting water to two of at least three flow paths.

Further features and advantages of the invention will become apparent from the following detailed description made with reference to the accompanying drawings.

DETAILED DESCRIPTION OF THE INVENTION

Figure 1:
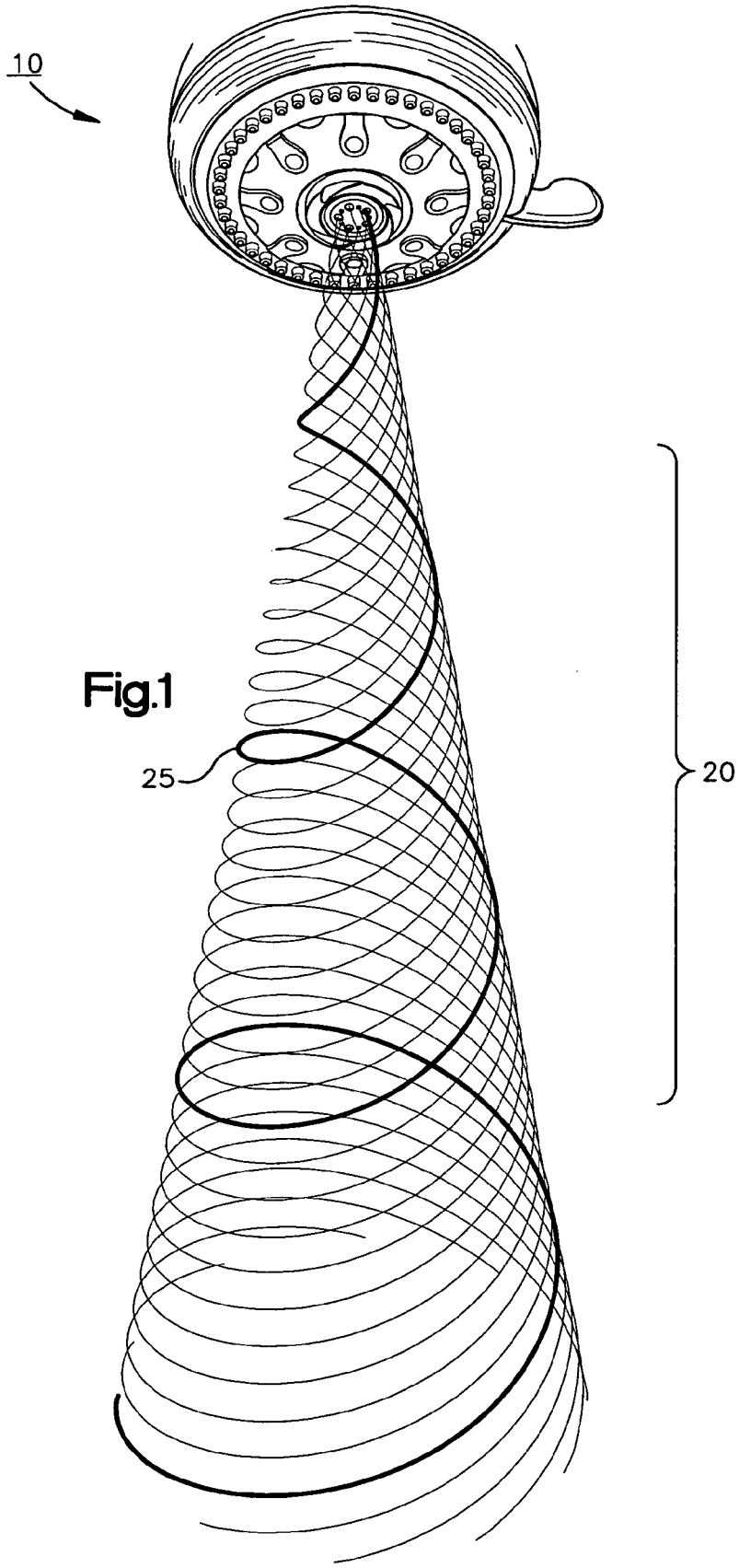
FIG. 1 is a perspective view of a portion of a shower head constructed in accordance with one embodiment of the present invention, showing a two-dimensional rendition of a revolving spray water pattern.

Referring now to the drawings, a shower head 10 constructed in accordance with one embodiment of the present invention is illustrated. The shower head has structural features that emit a spray pattern having advantageous physical and aesthetic characteristics.

The shower head is designed for user selection of up to four spray patterns, including the revolving or spiral spray pattern illustrated in FIG. 1. Other patterns include a steady stream full spray pattern, a bubbling spray pattern, and a combination of the steady stream fill spray and bubbling spray patterns.

Figure 3:
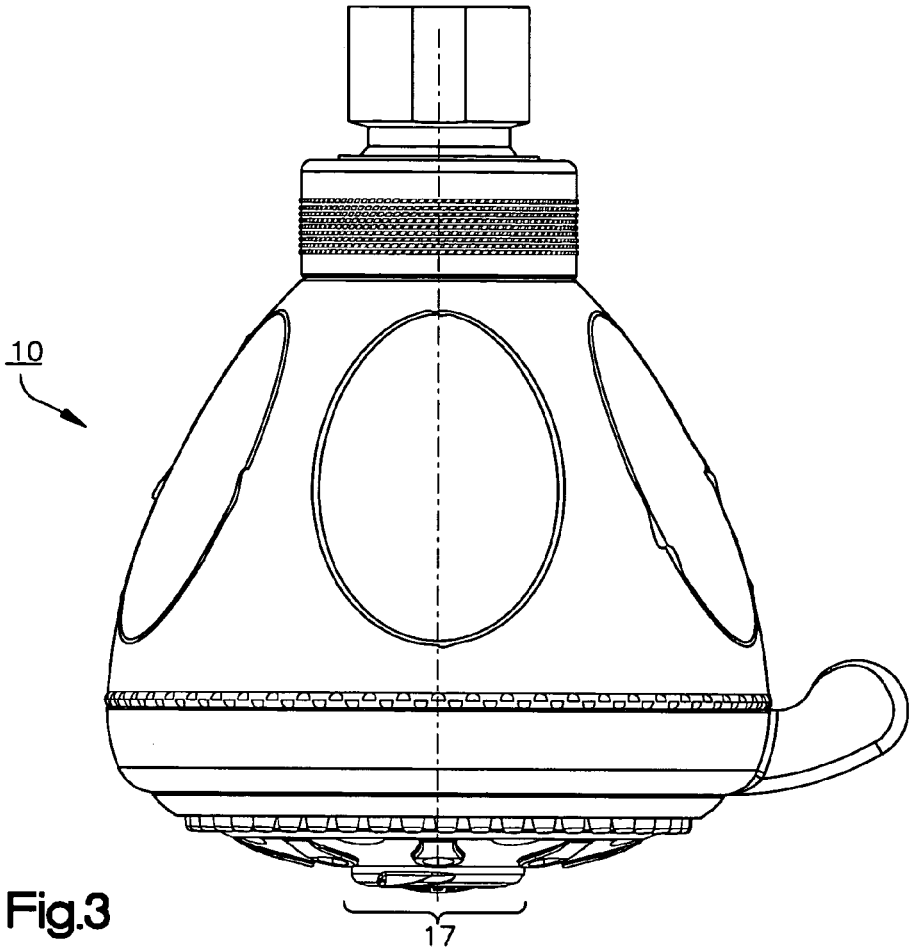
FIG. 3 is a side view of the shower head of FIG. 1.
Figure 4:
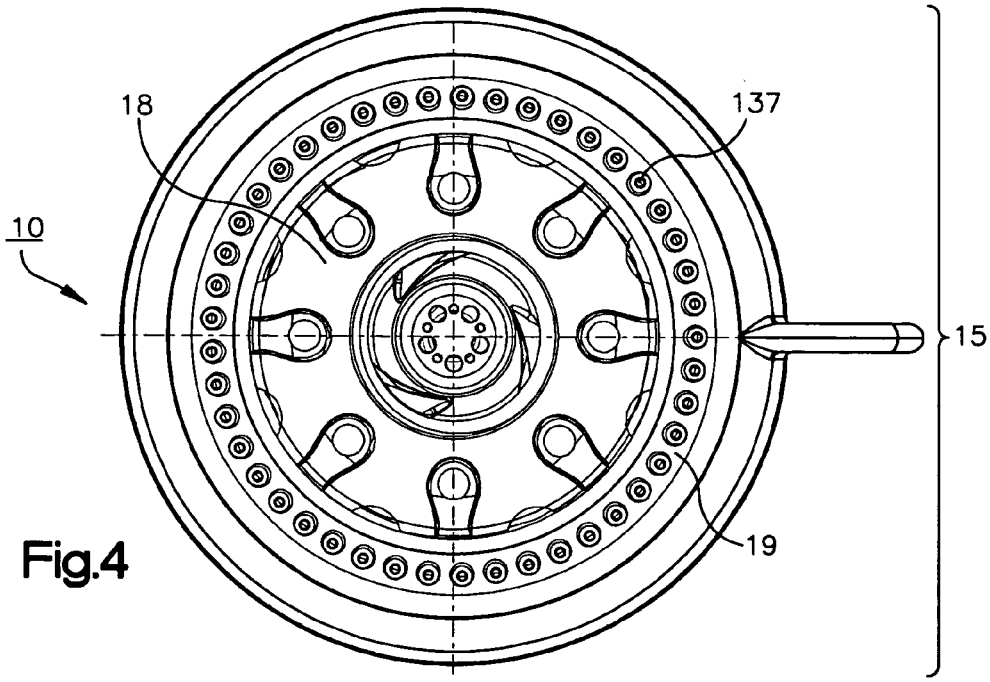
FIG. 4 is a front view of shower head of FIG. 1, showing the downstream facing surface including a first spray surface defined by a centrally disposed nozzle, a second spray surface defined by an intermediate radially disposed nozzle, and a third spray surface defined by an outward radially disposed nozzle.

As seen in FIG. 1, a schematic representation of the revolving or spiral spray pattern is shown. The spray pattern 20 emits from the shower head in such a way as to appear to be revolving. The emitted spray is not pulsating but rather constant in pressure. As shown in FIGS. 3 and 4, the revolving spray pattern is emitted from spray apertures in a center nozzle surface 17. This center nozzle surface rotates as it emits water, creating the revolving spray pattern 20. In the embodiment shown, 10 small spray apertures are defined in the spray surface 17. For purposes of perspective only, FIG. 1 illustrates an individual spray pattern 25 emitting from one single aperture. As one with ordinary skill in the art would expect, the spray pattern diffuses in size and intensity with distance from the spray surface 17. The rate of diffusion is a function of several features, including water pressure and rotation speed of the center nozzle spray surface 17.

Figure 2:
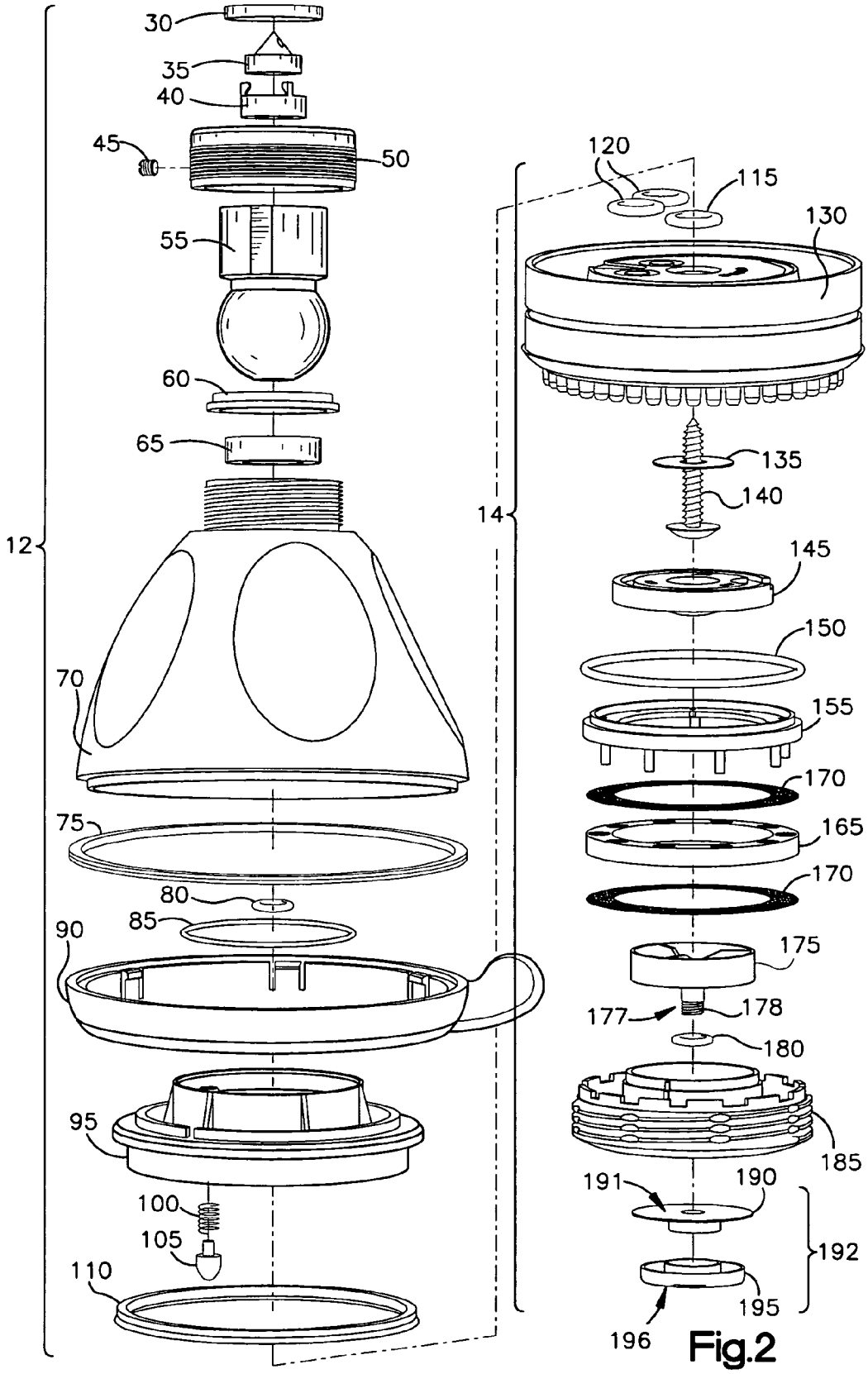
FIG. 2 is an exploded assembly view of the shower head of FIG. 1.

FIG. 2 is a perspective exploded assembly view of the shower head 10. The shower head includes an inlet assembly 12 and an outlet assembly 14. Water flow through the outlet assembly 14 drives an impeller 175 disposed within the outlet assembly 14. Rotation of the impeller consequently causes rotation of a rotator 195 spray surface 17 and water emission in a revolving pattern. The rotator 195 revolves at essentially the same speed as the impeller 175.

The inlet assembly 12 has an inlet end for mounting to a water source connection. The outer assembly 14 is in cooperative engagement with the inlet assembly and is disposed downstream therefrom. This engagement permits water flow from the water source into and through the outlet assembly. The outlet assembly has a body defining a front face surface 15 as shown in FIG. 4, and a rotatable impeller 175 disposed in a space relationship between the inlet assembly 12 and the front facing surface 15. The impeller has a plurality of blades 176 and an elongated tubular hub 178 which protrudes downstream. As illustrated, the rotator assembly 192 is mounted to the tubular hub 178. As shown in FIG. 2, the tubular hub 178 has a male threaded surface 177 that engages a female threaded connection (not shown) defined by an upstream surface 191 of an accessory disk 190. The rotator assembly 192 includes the accessory disk 190 which is press fit onto the rotator 195. A downstream facing surface 196 of the rotator defines ten small spray apertures 197*a*, 197*b*. Water flowing into the impeller and exiting the tubular hub flows into the rotator assembly and out the 10 spray apertures.

Referring again to FIG. 2, the inlet assembly 12 has a metal ball joint 55 to which a tubular nut 50 is connected. The metal ball joint 55 includes at an upstream end a hexagon nut connection having internal female threads. The inlet assembly allows for rotation of the shower head about a shower inlet pipe.

Figure 5:
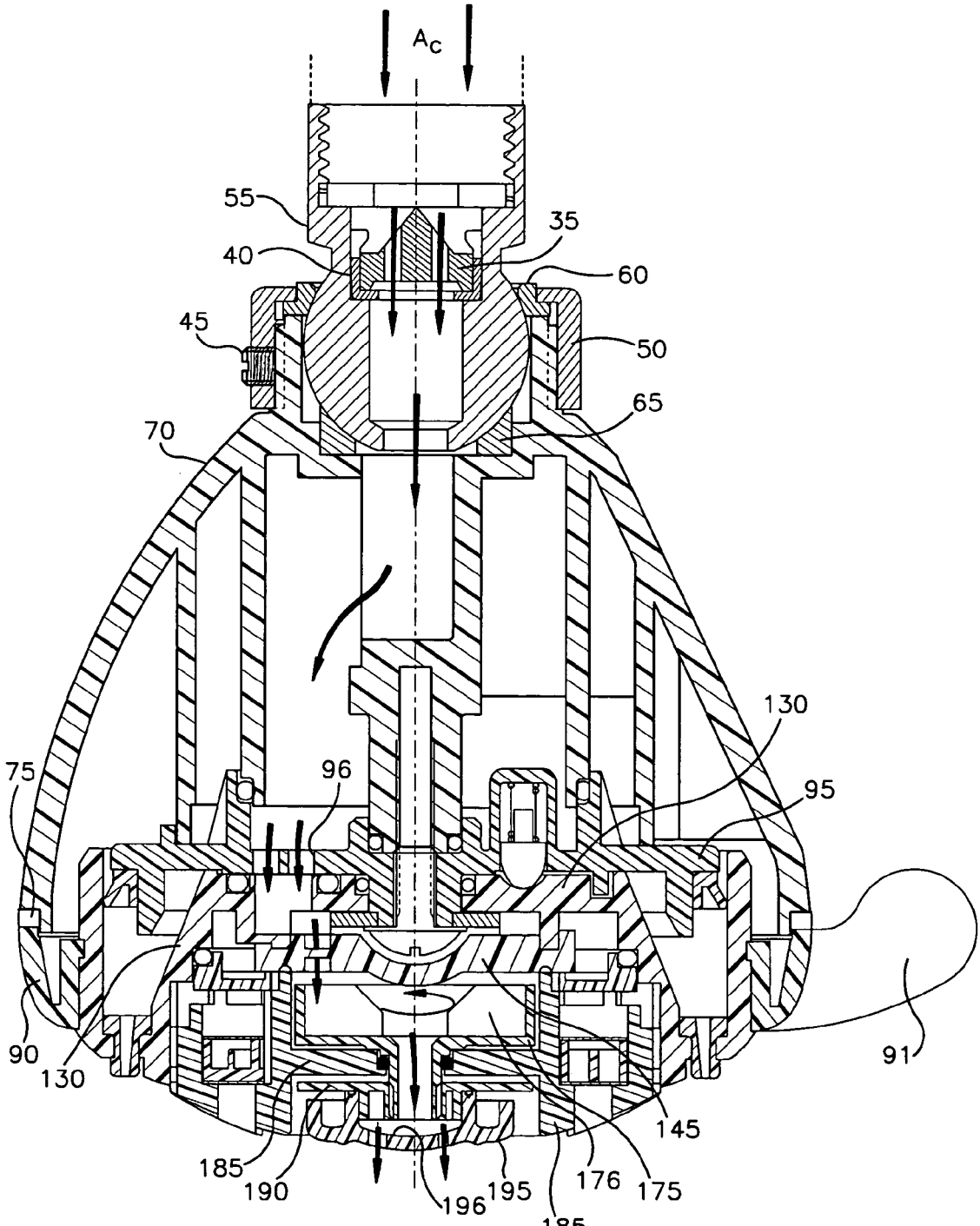
FIG. 5 is a cross-sectional view of the shower head of FIG. 1, showing the water flow pattern through the shower head in a center spray position.

FIG. 5 shows a cross sectional view of the shower head 10, including a schematic representation of water flow through the inlet and outlet assembly 12, 14. As seen in FIG. 5, a user may manipulate a dial ring 90 having a thumb tab 91 to divert water to at least one of three flow passages. A first flow passage represented by arrows in FIG. 5 illustrates water flow through the rotator 195 which produces the revolving flow pattern illustrated in FIG. 1. Water enters the ball joint 55 and passes through a flow restrictor 35 as shown. A gasket 65 maintains the downstream end of the ball joint in a sealed position with the housing 70. The tubular nut 50 and the annular lining 60 allow the shower head housing 70 to be rotated about the ball joint 55. As water enters the housing 70 along a center axis $A_c$, water is diverted off the center axis as shown by the arrows in FIG. 5. Next, water flows downstream through a fixed seat 95 that is disposed within the inlet assembly 12. As an operator manipulates the dial ring 90, the upstream face of a spray ring 130 rotates relative to the fixed downstream face of the fixed seat 95.

Figure 6:
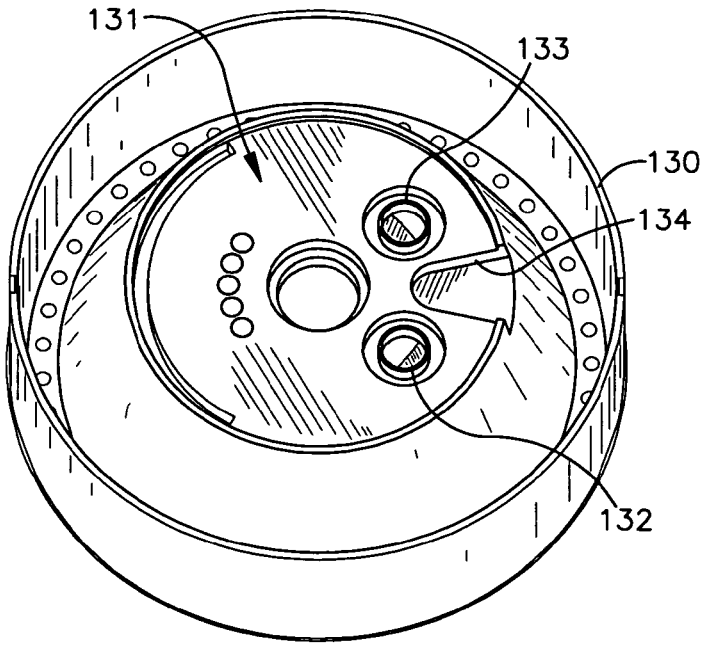
FIG. 6 is a perspective view of a component of the shower head of FIG. 1, showing the upstream facing surface of a spray ring.

Referring to FIG. 6, the upstream face of the spray ring 130 is illustrated. A port 132 defined by a surface 131 of the upstream face, permits water flow as illustrated in FIG. 5. When the spray ring 130 is manipulated such that water slow is permitted through a second port 133, water flow is emitted from the shower head to an intermediate nozzle producing a bubbling spray. In yet another user manipulated setting, when water is permitted to flow through a U-shaped cavity 134, a full spray is admitted from a series of spray nozzles disposed on an outward edge of the front facing surface 15.

Figure 8:
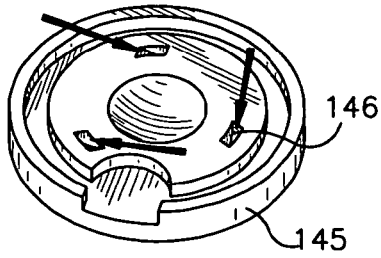
FIG. 8 is a perspective view of a component of the shower head of FIG. 1, showing the upstream facing surface of a seal spacer and directional water flow therethrough.
Figure 9:
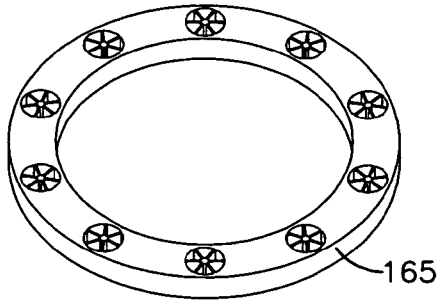
FIG. 9 is a perspective view of a component of the shower head of FIG. 1, showing the upstream facing surface of a bubble gasket.

Referring again to FIG. 5, water is shown flowing through two ports 96 within the fixed seat 95. Water then contacts an upstream face of a seal spacer 145. A top view of the seal spacer is illustrated in FIG. 8. The seal spacer is disposed in a space relationship between the inlet assembly of the shower head and the front facing surface 15. The seal spacer includes three radially spaced ports 146. Each port is axially transverse to a plane of the seal spacer, as well as being non-parallel to the center axis $A_c$. In other words, as water flows through each port 146, the flow is neither parallel nor perpendicular to the plane defined by the seal spacer nor to the center axis $A_c$. Arrows in FIG. 8 represent water flow through these ports.

Figure 10:
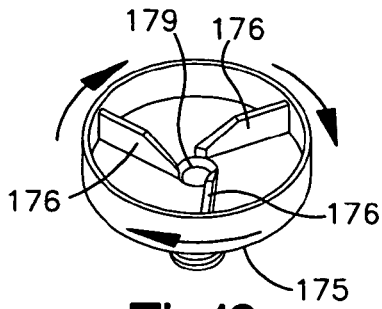
FIG. 10 is a perspective view of a component of the shower head of FIG. 1, showing the upstream facing surface of an impeller and one rotational direction.

Once again referring to FIG. 5, water now exits the seal spacer in three locations, creating a circular flow pattern that engages an upstream face of the impeller 175. This circular flow pattern engages the impeller blades 176 and creates a rotation of the impellers about the center axis. It should be understood by those skilled in the art that in the practice of the present invention, the seal spacer may be constructed such that clockwise or counter clockwise rotation of the impeller may occur. FIG. 10 is a top view of the upstream face of the impeller. Arrows in FIG. 10 represent clockwise flow of water engaging the impeller blades 176. Water flow continues downstream into an internal passage way 179 within the tubular hub 178.

Downstream from the impeller upstream surface, water flow through the tubular hub 178 is illustrated by an arrow in FIG. 5. Water exiting the tubular hub 178 briefly gathers within a cavity on the upstream side of the rotator 195 defined by a cavity wall 196. As water gathers in this cavity it is dispersed to 10 spray apertures. The ten spray apertures include five large apertures 197*a* and five small apertures 197*b*. It should be understood by those skilled in the art that any suitable aperture pattern, size or number may be utilized in the practice of this invention.

Figure 7:
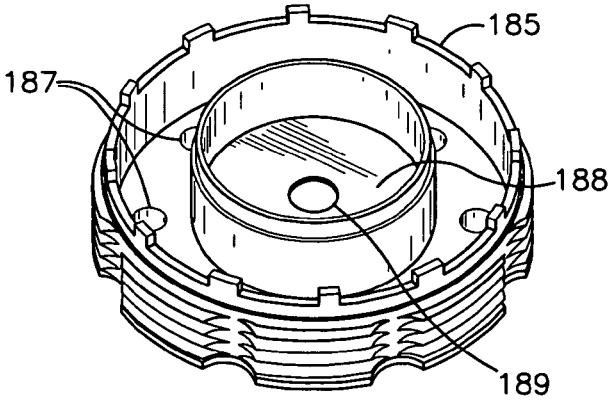
FIG. 7 is a perspective view of a component of the shower head of FIG. 1, showing the upstream facing surface of a face plate.

Referring again to FIG. 2, as water is emitted from the rotator 195, the rotator is spinning. This spinning motion is created by its fixed relation to the impeller 175. In assembly of the shower head 10, the tubular hub 178 is inserted through an O ring 180. The tubular hub 178 is then inserted through a center mounting hole 187 in the upstream face of a face plate 185. The upstream face of the face plate is illustrated in FIG. 7.

Figure 11:
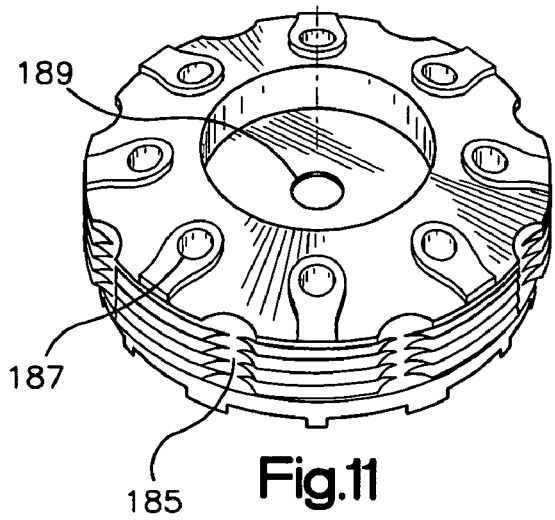
FIG. 11 is a perspective view of the face plate of FIG. 7, showing a downstream facing surface.
Figure 12:
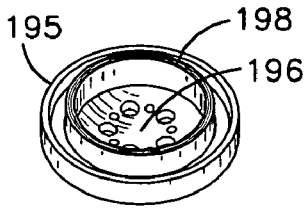
FIG. 12 is a perspective view of a component of the shower head of FIG. 1, showing the upstream facing surface of a rotator.
Figure 13:
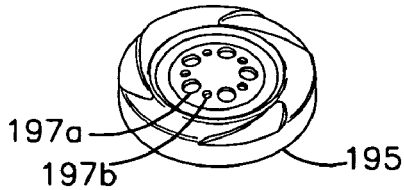
FIG. 13 is a perspective view of the rotator of FIG. 12, showing a downstream facing surface.
Figure 14:
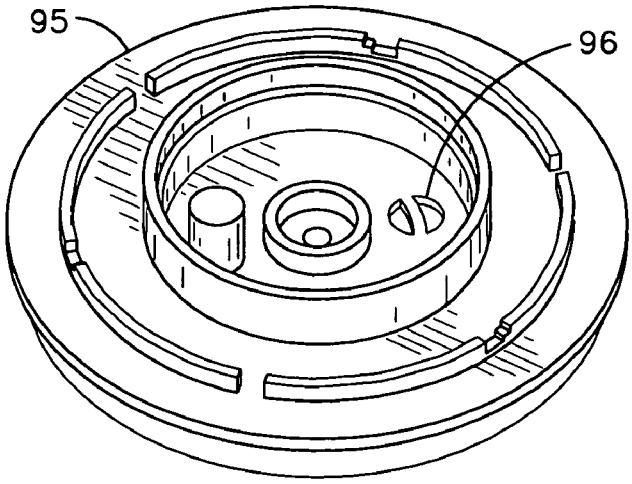
FIG. 14 is a perspective view of a component of the shower head of FIG. 1, showing the upstream facing surface of a fixed seat.

On the downstream side of the face plate 185 shown in FIG. 11, the male threaded connection of the tubular hub 178 engages female threads of the accessory disk 190. The accessory disk includes two concentric protruding annular rings on its downstream face. These rings are press fit over either side wall of a single protruding annular ring 198 on the upstream face of the rotator 195. The upstream face of the rotator is illustrated in FIG. 13. The above described assembly allows the impeller 175 and rotator 195 to spin concurrently in the same direction and at essentially the same rotations per minute. This spinning motion occurs relative to the fixed face plate 185. The face plate includes threads on its circumferential surface which engage a female threaded internal wall within a downstream cavity of the spray ring 130.

Referring to FIGS. 3 and 4, a side view and front face view of the shower head 10 is shown. The front facing surface 15 of the shower head includes a center nozzle surface 17 an intermediately disposed nozzle surface 18 and an outwardly disposed nozzle surface 19. As shown, the center nozzle surface 17 protrudes a greater distance downstream relative to the intermediately disposed nozzle surface 19. It should be apparent to others with ordinary skill in the art that the nozzles' relative positioning downstream may vary.

The embodiment of the invention shown in FIG. 5 allows for three alternative flow patterns of water as discussed in the orientation shown in FIG. 5 water emits through a center nozzle surface 17 producing a revolving spray pattern. A user may manipulate the dial ring 90 to produce a second flow pattern which emits a bubbling spray pattern through the intermediately disposed nozzle 18. Referring again to FIG. 2, this bubbling spray is created as water flows through a first filter mesh ring 170 a bubble gasket 165, and a second filter mesh ring 170. Water then emits in a bubbling spray pattern through spray apertures 187 in the face plate 185. A third flow pattern that may be selected by a user emits water from the outwardly disposed nozzle surface 19. The outwardly disposed nozzle includes a plurality of equally spaced flexible spray nozzles 137. Water emitted from these spray nozzles is non-revolving in nature.

Figure 15:
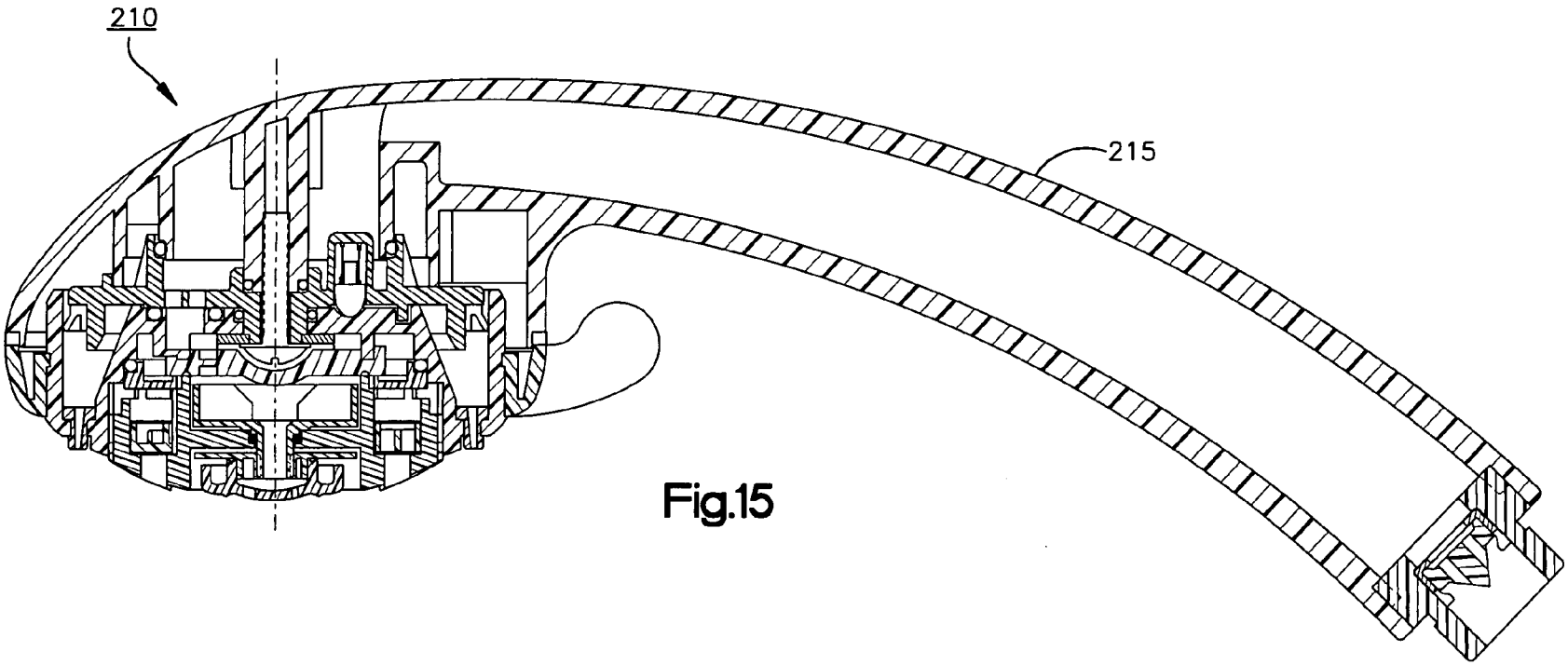
FIG. 15 is a cross-sectional view of shower head constructed in accordance with an alternative embodiment of the present invention, showing the shower head in a center spray position.

A second embodiment of the present invention is illustrated in FIG. 15. FIG. 15 shows a cross sectional view of a hand held shower head 210. The hand held shower head 210 includes the same or similar internal components that generate the revolving spray pattern. Further, the shower head includes an extendable arm housing 215 in contrast to the ball joint inlet connection and fixed shower head housing 70 incorporated in the fixed shower head design. It should be understood by others with ordinary skill in the art that other shower head designs configurations and styles may be utilized in the practice of the present invention.

While a single embodiment of the invention has been illustrated and described in considerable detail, the present invention is not to be considered limited to the precise construction disclosed. Various adaptations, modifications and uses of the invention may occur to those skilled in the arts to which the invention relates. It is the intention to cover all such adaptations, modifications and uses falling within the scope or spirit of the claims filed herewith.

What is claimed is:

1. A shower head for emitting a revolving spray pattern, said shower head comprising:

a) an inlet assembly having an inlet end for mounting to a water source connection; and b) an outlet assembly in cooperative engagement with said inlet assembly and disposed downstream therefrom to permit water flow from said water source to said outlet assembly, said outlet assembly having:

i) a body defining a front face surface;

ii) a rotatable impeller disposed in a spaced relationship between said inlet assembly and said front face surface and having a plurality of blades and an elongated tubular hub protruding downstream;

iii) a rotator assembly mounted to said tubular hub and comprising a spray surface defining a plurality of spray apertures, such that water entering said tubular hub exits said outlet assembly through said spray apertures;

(iv) wherein said rotator spray surface comprises a portion of said outlet assembly front face surface; and c) wherein water flow through said outer assembly drives said impeller thereby causing rotation of said rotator spray surface and water emission in a revolving spray pattern and wherein said outlet assembly further comprises a bubbling spray generator apparatus, wherein said apparatus comprises an inlet portion, a wire mesh annular filter, a bubble gasket and an outlet portion, wherein said apparatus generates a bubbling spray when water flow traverses said inlet portion and said outlet portion.

2. The shower head of claim 1 wherein said outlet assembly further comprises means for generating a non-revolving spray pattern.

3. The shower head of claim 1 further comprising means for an operator to divert water to one of at least three flow paths.

4. The shower head of claim 1 wherein said inlet assembly comprises a fixed seat and said outlet assembly comprises a dial ring and a spray ring, wherein an operator may adjust said dial ring thereby manipulating said spray ring with respect to said fixed seat to divert water to two of at least three flow paths.

5. The shower head of claim 1 further comprising means for an operator to divert water to two of at least three flow paths.

6. A shower head for emitting a revolving spray pattern, said shower head comprising:

a) an inlet assembly having an inlet end for mounting to a water source connection; and b) an outlet assembly in cooperative engagement with said inlet assembly and disposed downstream therefrom to permit water flow from said water source to said outlet assembly, said outlet assembly having:

i) a body defining a front face surface;

ii) a rotatable impeller disposed in a spaced relationship between said inlet assembly and said front face surface and having a plurality of blades and an elongated tubular hub protruding downstream;

iii) a rotator assembly mounted to said tubular hub and comprising a spray surface defining a plurality of spray apertures, such that water entering said tubular hub exits said outlet assembly through said spray apertures;

iv) wherein said rotator spray surface comprises a portion of said outlet assembly front face surface; and c) wherein water flow through said outer assembly drives said impeller thereby causing rotation of said rotator spray surface and water emission in a revolving spray pattern and wherein said inlet assembly further comprises a fixed seat and said outlet assembly further comprises a spray generator apparatus, wherein said apparatus comprises a spray ring having a plurality of flexible nozzles, wherein said apparatus generates a spray when an operator manipulates said spray ring with respect to said fixed seat to divert water flow to said flexible nozzles.

7. The shower head of claim 6 wherein said outlet assembly further comprises means for generating a bubbling spray.

8. A shower head for emitting a revolving spray pattern, said shower head comprising:

a) an inlet assembly having an inlet end for mounting to a water source connection; and b) an outlet assembly in cooperative engagement with said inlet assembly and disposed downstream therefrom to permit water flow from said water source to said outlet assembly, said outlet assembly having:

i) a body defining a front face surface;

ii) a rotatable impeller disposed in a spaced relationship between said inlet assembly and said front face surface and having a plurality of blades and an elongated tubular hub protruding downstream;

iii) a rotator assembly mounted to said tubular hub and comprising a spray surface defining a plurality of spray apertures, such that water entering said tubular hub exits said outlet assembly through said spray apertures;

iv) wherein said rotator spray surface comprises a portion of said outlet assembly front face surface; and c) wherein water flow through said outer assembly drives said impeller thereby causing rotation of said rotator spray surface and water emission in a revolving spray pattern and wherein said inlet assembly comprises a fixed seat and said outlet assembly comprises a dial ring and a spray ring, wherein an operator may adjust said dial ring thereby manipulating said spray ring with respect to said fixed seat to divert water to one of at least three flow paths.

9. A shower head comprising:

a) a body having a center axis, an inlet end for receiving water flow from a water source and an outlet end defining a front facing surface;

b) a seal spacer disposed in a spaced relationship between said inlet end and said front facing surface having a plurality of radially spaced ports, each port axially transverse to a plane of said seal spacer, wherein water flow through said ports creates a rotating water current downstream from said spacer;

c) a rotatable impeller disposed in a spaced relationship between said seal spacer and said front facing surface and having a center port and plurality of blades such that said impeller is driven by said rotating water current; and d) a rotator assembly mounted to said impeller and having a spray surface defining a plurality of spray apertures, wherein said spray surface comprises a portion of said front facing surface;

e) wherein water flow through said center port impeller exits said spray apertures thereby causing water emission in a revolving pattern as said rotator assembly cooperatively spins with said impeller.

10. The shower head of claim 9 further comprising a bubbling spray generator apparatus, wherein said apparatus comprises an inlet portion, a wire mesh annular filter, a bubble gasket and an outlet portion, wherein said apparatus generates a bubbling spray when water flow traverses said inlet portion and said outlet portion.

11. The shower head of claim 9 further comprising means for generating a bubbling spray.

12. The shower head of claim 9 further comprising a spray generator apparatus, wherein said apparatus comprises a fixed seat and a spray ring having a plurality of flexible nozzles, wherein said apparatus generates a non-revolving spray pattern when an operator manipulates said spray ring with respect to said fixed seat to divert water flow to said flexible nozzles.

13. The shower head of claim 9 further comprising a dial ring, a spray ring and a fixed seat, wherein an operator may adjust said dial ring thereby manipulating said spray ring with respect to said fixed seat to divert water to one of at least three flow paths.

14. The shower head of claim 9 further comprising means for an operator to divert water to one of at least three flow paths.

15. The shower head of claim 9 further comprising a dial ring, a spray ring and a fixed seat, wherein an operator may adjust said dial ring thereby manipulating said spray ring with respect to said fixed seat to divert water to two of at least three flow paths.

16. The shower head of claim 9 further comprising means for an operator to divert water to two of at least three flow paths.

17. A shower head comprising:

a) a body having a center axis, an inlet end and an outlet end, said outlet end defining a front facing surface, wherein water entering said inlet end flows downstream through said body and out said outlet end;

b) a seal spacer disposed in a spaced relationship between said inlet end and said front facing surface having a plurality of radially spaced ports, each port axially transverse to a plane of said seal spacer;

c) a rotatable impeller disposed in a spaced relationship between said seal spacer and said front facing surface and having a plurality of blades, such that said impeller is driven by water flowing out of said radially spaced ports; and d) a rotator assembly engaged to said impeller and having a downstream surface defining a plurality of spray apertures, wherein said downstream surface comprises a center portion of said front facing surface;

e) wherein rotation of said impeller causing cooperative rotation of said rotator assembly.

18. The shower head of claim 17 further comprising a bubbling spray generator apparatus, wherein said apparatus comprises an inlet portion, a wire mesh annular filter, a bubble gasket and an outlet portion, wherein said apparatus generates a bubbling spray when water flow traverses said inlet portion and said outlet portion.

19. The shower head of claim 17 further comprising means for generating a bubbling spray.

20. The shower head of claim 17 further comprising a spray generator apparatus, wherein said apparatus comprises a fixed seat and a spray ring having a plurality of flexible nozzles, wherein said apparatus generates a non-revolving spray pattern when an operator manipulates said spray ring with respect to said fixed seat to divert water flow to said flexible nozzles.

21. The shower head of claim 17 further comprising a dial ring, a spray ring and a fixed seat, wherein an operator may adjust said dial ring thereby manipulating said spray ring with respect to said fixed seat to divert water to one of at least three flow paths.

22. The shower head of claim 17 further comprising means for an operator to divert water to one of at least three flow paths.

23. The shower head of claim 17 further comprising a dial ring, a spray ring and a fixed seat, wherein an operator may adjust said dial ring thereby manipulating said spray ring with respect to said fixed seat to divert water to two of at least three flow paths.

24. The shower head of claim 17 further comprising means for an operator to divert water to two of at least three flow paths.

25. A shower head nozzle comprising:

a) a body having an inlet end, an outlet end, and structure defining an internal water passageway wherein water entering said inlet end flows downstream through said body and out said outlet end, wherein said outlet end defines a circular nozzle spray surface;

b) a seal spacer disposed in a spaced relationship between said inlet end and said nozzle spray surface having a plurality of radially spaced ports;

c) a rotatable impeller disposed in a spaced relationship between said seal spacer and said nozzle spray surface and having a plurality of blades, such that said impeller is driven by water flowing out of said radially spaced ports; and d) a center nozzle engaged to said impeller and having a second spray surface defining a plurality of spray apertures, wherein said center nozzle spray surface comprises a centrally disposed portion of said circular nozzle spray surface;

e) wherein water flow through said body causes rotation of said center nozzle.

26. The shower head of claim 25 further comprising a bubbling spray generator apparatus, wherein said apparatus comprises an inlet portion, a wire mesh annular filter, a bubble gasket and an outlet portion, wherein said apparatus generates a bubbling spray when water flow traverses said inlet portion and said outlet portion.

27. The shower head of claim 25 further comprising means for generating a bubbling spray.

28. The shower head of claim 25 further comprising a spray generator apparatus, wherein said apparatus comprises a fixed seat and a spray ring having a plurality of flexible nozzles, wherein said apparatus generates a non-revolving spray pattern when an operator manipulates said spray ring with respect to said fixed seat to divert water flow to said flexible nozzles.

29. The shower head of claim 25 further comprising a dial ring, a spray ring and a fixed seat, wherein an operator may adjust said dial ring thereby manipulating said spray ring with respect to said fixed seat to divert water to one of at least three flow paths.

30. The shower head of claim 25 further comprising means for an operator to divert water to one of at least three flow paths.

31. The shower head of claim 25 further comprising a dial ring, a spray ring and a fixed seat, wherein an operator may adjust said dial ring thereby manipulating said spray ring with respect to said fixed seat to divert water to two of at least three flow paths.

32. The shower head of claim 25 further comprising means for an operator to divert water to two of at least three flow paths.

33. A shower head comprising:

a) a body having an inlet end for introducing water flow into the body, an outlet end defining a body spray surface, and structure defining at least one internal water passageway wherein water entering said inlet end flows through said body and out said outlet end;

b) wherein said body spray surface comprises a first spray surface defined by a centrally disposed nozzle, and a second spray surface defined by an outward radially disposed nozzle;

c) wherein water flow through said at least one internal water passageway causes rotation of said centrally disposed nozzle with respect to said outward radially disposed nozzle; and d) a bubbling spray generator apparatus, wherein said apparatus comprises an inlet portion, a wire mesh annular filter, a bubble gasket and an outlet portion, wherein said apparatus generates a bubbling spray when water flow traverses said inlet portion and said outlet portion.

34. The shower head of claim 33 further comprising means for an operator to divert water to two of at least three flow paths.

35. The shower head of claim 33 further comprising a dial ring, a spray ring and a fixed seat, wherein an operator may adjust said dial ring thereby manipulating said spray ring with respect to said fixed to divert water to two of at least three flow paths.

36. The shower head of claim 33 further comprising means for an operator to divert water to two of at least three flow paths.

37. A shower head comprising:

a) a body having an inlet end for introducing water flow into the body, an outlet end defining a body spray surface, and structure defining at least one internal water passageway wherein water entering said inlet end flows through said body and out said outlet end;

b) wherein said body spray surface comprises a first spray surface defined by a centrally disposed nozzle, and a second spray surface defined by an outward radially disposed nozzle;

c) wherein water flow through said at least one internal water passageway causes rotation of said centrally disposed nozzle with respect to said outward radially disposed nozzle; and d) a spray generator apparatus, wherein said apparatus comprises a fixed seat and a spray ring having a plurality of flexible nozzles, wherein said apparatus generates a non-revolving spray pattern when an operator manipulates said spray ring with respect to said fixed seat to divert water flow to said flexible nozzles.

38. The shower head of claim 37 further comprising means for generating a bubbling spray.

39. A shower head comprising:

a) a body having an inlet end for introducing water flow into the body, an outlet end defining a body spray surface, and structure defining at least one internal water passageway wherein water entering said inlet end flows through said body and out said outlet end;

b) wherein said body spray surface comprises a first spray surface defined by a centrally disposed nozzle, and a second spray surface defined by an outward radially disposed nozzle;

c) wherein water flow through said at least one internal water passageway causes rotation of said centrally disposed nozzle with respect to said outward radially disposed nozzle; and d) a dial ring, a spray ring and a fixed seat, wherein an operator may adjust said dial ring thereby manipulating said spray ring with respect to said fixed seat to divert water to one of at least three flow paths.

40. A shower head comprising:

a) a body having an inlet end for introducing water flow into the body, an outlet end defining a body spray surface, and structure defining at least one internal water passageway wherein water entering said inlet end flows through said body and out said outlet end;

b) wherein said body spray surface comprises a first spray surface defined by a first nozzle, a second spray surface defined by a second nozzle, and a third spray surface;

c) wherein water flow through said at least one internal water passageway causes rotation of said first nozzle with respect to said second nozzle; and d) a fixed seat, a spray ring in contact with said fixed seat and a dial ring coupled to said spray ring, said dial ring adjustable to three positions to manipulate said spray ring with respect to said fixed seat wherein in a first position of said dial ring water is diverted along a first flow oath to said first spray surface, in a second position of said dial ring water is diverted along a second flow path to said second spray surface and in a third position of said dial ring water is diverted along a third flow path to said third spray surface.

41. The shower head of claim 40 further comprising a bubbling spray generator apparatus, wherein said apparatus comprises an inlet portion, a wire mesh annular filter, a bubble gasket and an outlet portion, wherein said apparatus generates a bubbling spray when water flow traverses said inlet portion and said outlet portion.

42. The shower head of claim 40 further comprising means for generating a bubbling spray.

43. The shower head of claim 40 wherein the third spray surface is defined a third nozzle.

44. The shower head of claim 43 wherein the third nozzle is radially outward of the second nozzle.

45. The shower head of claim 40 wherein the first nozzle is a centrally disposed nozzle.

46. The shower head of claim 40 wherein the second nozzle is radially outward of the first nozzle.

47. The shower head of claim 40 wherein said spray ring is rotatable with respect to said fixed seat.

* * * * *